US006688050B2

(12) United States Patent
Sagiao

(10) Patent No.: US 6,688,050 B2
(45) Date of Patent: Feb. 10, 2004

(54) ADJUSTABLE SUPPORT SYSTEM

(76) Inventor: Malofou Sagiao, 613 S. Kenmore St., Anaheim, CA (US) 92804

( * ) Notice: Subject to any disclaimer, the term of this patent is extended or adjusted under 35 U.S.C. 154(b) by 0 days.

(21) Appl. No.: 09/897,834

(22) Filed: Jun. 29, 2001

(65) Prior Publication Data

US 2003/0000168 A1 Jan. 2, 2003

(51) Int. Cl.[7] ..... E04B 2/82; E04B 9/00

(52) U.S. Cl. ..... 52/126.1; 52/645; 52/127.2; 182/45; 108/64

(58) Field of Search ..... 52/749.12, 749.11, 52/24, 126.1, 645, 646, 127.2; 248/237, 201, 405, 407, 188.5, 188.8, 148; 182/45, 206; 108/64

(56) References Cited

U.S. PATENT DOCUMENTS

| | | | | | |
|---|---|---|---|---|---|
| 3,771,273 | A | * | 11/1973 | Brodie | 52/646 |
| 4,068,427 | A | * | 1/1978 | Camardo | 52/127 |
| 5,249,397 | A | * | 10/1993 | Monaco | 52/126.1 |
| 5,318,148 | A | * | 6/1994 | Franco et al. | 182/45 |
| 5,346,036 | A | * | 9/1994 | Arisman et al. | 182/3 |
| 5,624,006 | A | * | 4/1997 | Richardson, Jr. | 182/45 |
| 5,788,204 | A | * | 8/1998 | Goodwin et al. | 182/111 |
| 5,875,592 | A | * | 3/1999 | Allman et al. | 52/198 |
| 5,913,782 | A | * | 6/1999 | Monaco et al. | 182/45 |
| 5,950,760 | A | * | 9/1999 | Morrison | 182/82 |
| 5,960,904 | A | * | 10/1999 | Ullmann | 182/45 |
| 5,988,578 | A | * | 11/1999 | Davies | 248/237 |
| 6,003,629 | A | * | 12/1999 | Cloutier et al. | 182/113 |
| 6,167,987 | B1 | * | 1/2001 | Jensen | 182/45 |
| 6,195,066 | B1 | * | 2/2001 | Pegues et al. | 248/237 |
| 6,464,196 | B1 | * | 10/2002 | Crookham et al. | 248/519 |

FOREIGN PATENT DOCUMENTS

| | | | | |
|---|---|---|---|---|
| DE | 4006759 | * | 9/1991 | E04F/21/02 |
| EP | 0235060 | * | 1/1987 | E04B/1/26 |
| JP | 6-235241 | * | 8/1994 | E04B/5/43 |

* cited by examiner

*Primary Examiner*—Carl D. Friedman
*Assistant Examiner*—Chi Q. Nguyen
(74) *Attorney, Agent, or Firm*—Kenneth W. Float

(57) ABSTRACT

An adjustable support system for use in roofing and object support applications, such as on vehicles. An exemplary system includes first and second offset support members that each comprise a base, a first member rotatably and lockably attached to the base, a second member slidably and lockably attached to the first member, and a transverse member attached to the second member. The transverse members of the first and second offset support members are coupled together and are laterally adjustable with respect to each other. The first and second members and the transverse members are preferably tubular. An alternative embodiment has the transverse member of one support member rotatably attached to the end of a base.

20 Claims, 4 Drawing Sheets

ADJUSTABLE SUPPORT SYSTEM

BACKGROUND

The present invention relates generally to support systems, and more particularly, to an adjustable support system having multi-dimensional adjustability.

The present invention was developed to solve a problem associated with roofing and other house repairs that require workers to walk or otherwise be supported by breakable tiles on a roof, particularly one that is sloped. For example, when a house is fumigated, a fumigation bag or enclosure is used to cover the house. In order to install the fumigation bag, it is often times necessary for workers to walk on the roof in order to fully cover the entire house.

One known method that helps to protect the tiles is the use of a flat board or panel (1 feet by 4 feet, for example) having foam under it. This structure helps to spread out the weight of workers. However, it has been found that tiles are still broken using this structure.

Unfortunately, workers that do not have a great deal of experience working on roofs, or in situations where roof tiles are relatively fragile, many roof tiles are broken during the bag installation procedure. Similar situations may occur during window washing, aftermarket gutter installation, and antenna installation, and the like.

The cost of repairing the broken roof tiles is expensive, many time on the order of the cost of the job that is being performed. The present invention substantially eliminates the occurrence of broken roof tiles during roof-related operations.

In addition, there may be times when articles need to be stored or carried where the surface is not level or two mounting locations are not at the same height. In such a situation, it is often difficult to efficiently store or carry an object. The present invention is also designed to provide a solution for these problems.

It is therefore an objective of the present invention to provide for an adjustable support system having multi-dimensional adjustability. It is also an objective of the present invention to provide for an adjustable support system that may be employed to support people and objects above a surface. It is also an objective of the present invention to provide for an adjustable support system that may be employed to support people and objects where the surface on which the support system is placed in not horizontal or where support locations are not at the same height.

SUMMARY OF THE INVENTION

The present invention provides for an adjustable support system having multi-dimensional adjustability. An exemplary adjustable support system comprises first and second offset support members. Each support member comprises a base that may be secured to a surface or object. The base preferably has one or more holes that allow it to be secured to the surface or object. The base comprises a U-shaped member or similar functioning bracket that projects away from a surface thereof.

A first member, which is preferably tubular, is rotatably attached and secured to the base, such as to the U-shaped member or bracket, of each support member. A second member, which is also preferably tubular, is slidably attached to the first member of each support member. A protective cap, or other resilient member, for example, may be disposed to cover the exposed end of the second members.

The first and second members are thus slidable or adjustable with respect to each other so that the distal end of the second member may be positioned at different distances from the base. The first and second members may be locked in a desired position by means of a locking mechanism such as a bolt and nut, that extends through holes in the first and second members. Multiple sets of holes may be disposed through the first and second member that permit locking of the second member at different positions. The positions that the second member with respect to the first member are locked at may be different for each of the support members.

A first transverse member is attached to the second member of the first support member. A second transverse member is attached to the second member of the second support member. The first transverse member is slidable or adjustable with respect to the second transverse member. This allows for lateral or transverse positioning of the first and second support members at different distances from each other.

If first and second tubular transverse members are used, the first and second support members may be rotated with respect to each other around axes of the if the first and second tubular transverse members. This, in conjunction with the rotatable joint provided between the base and the first member, allows one of the support members to be secured to a different surface than that of the other support member.

In an alternative embodiment of the support system, the transverse member of one of the support members has one or more holes therethrough (depending upon whether it is tubular or solid) that is distal from the second member. In this alternative embodiment, the transverse member is rotatably attached and secured directly to the base, such as to the U-shaped member or bracket thereof by means of a locking mechanism such as a bolt and nut. Thus, in this alternative embodiment, the base is removed from one of the support members and is attached to the transverse member of the other support member.

An optional rotatable member may be rotatably and/or slidably coupled at a first end to one of the transverse members. A second end of the rotatable member preferably has a hole therein that allows it to be secured to a surface. Use of the rotatable member helps to stabilize the adjustable support system.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
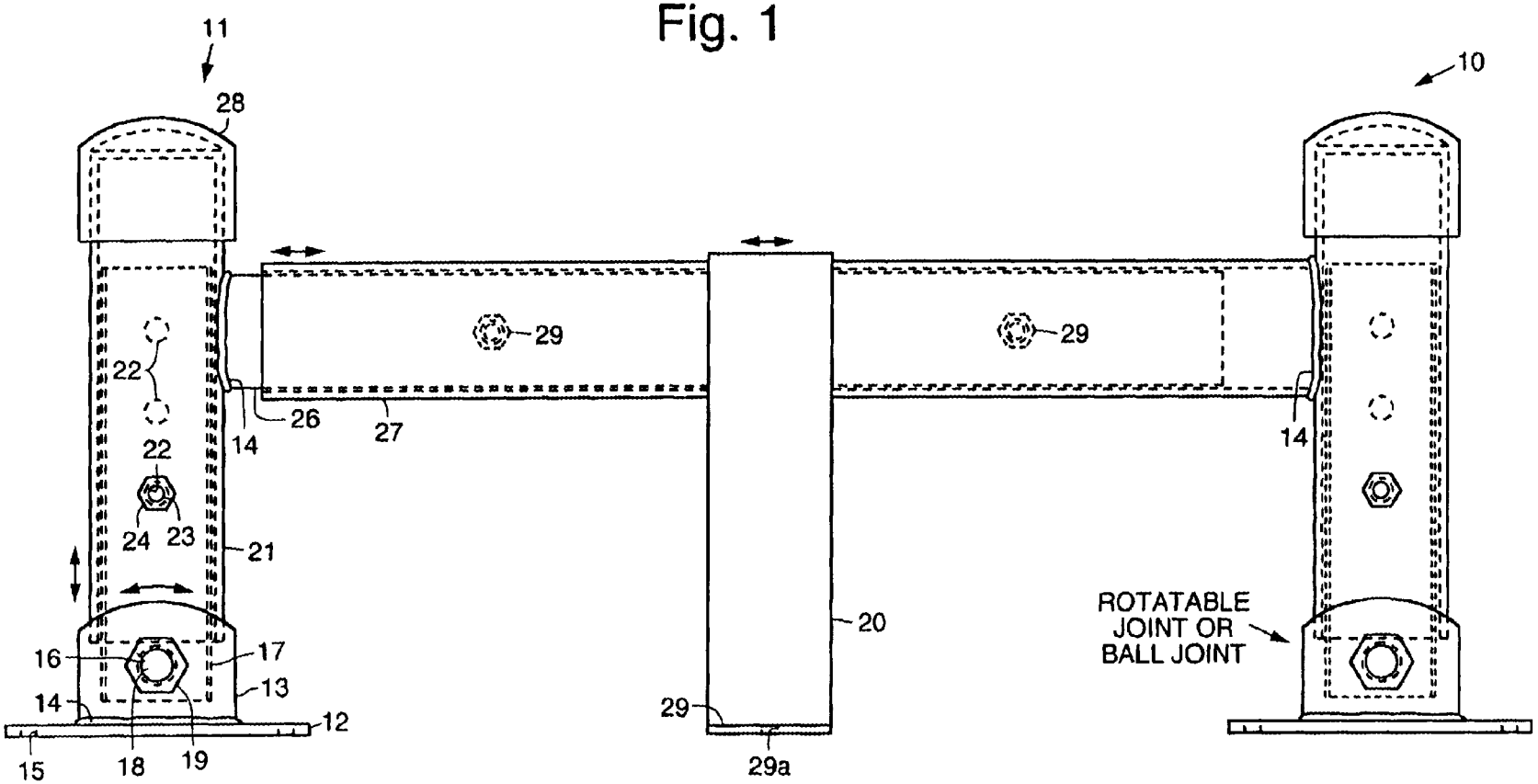
FIG. 1 illustrates various embodiments of adjustable support systems in accordance with the principles of the present invention.
Figure 2A:
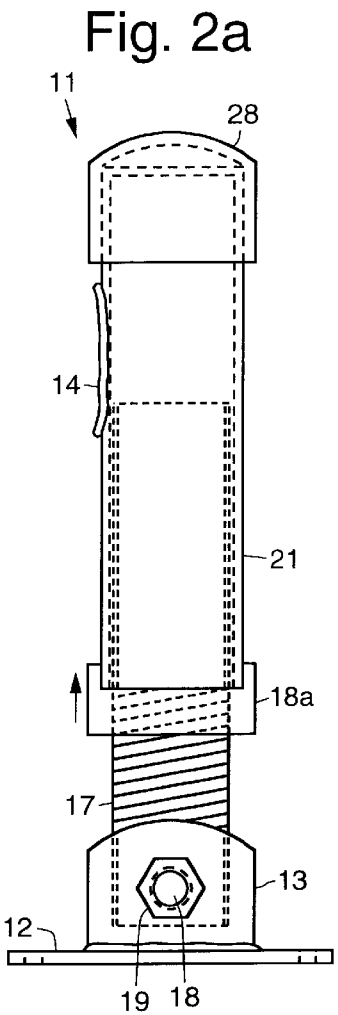
FIG. 2*a* illustrates details of an alternative embodiment of the adjustable support system.
Figure 2:
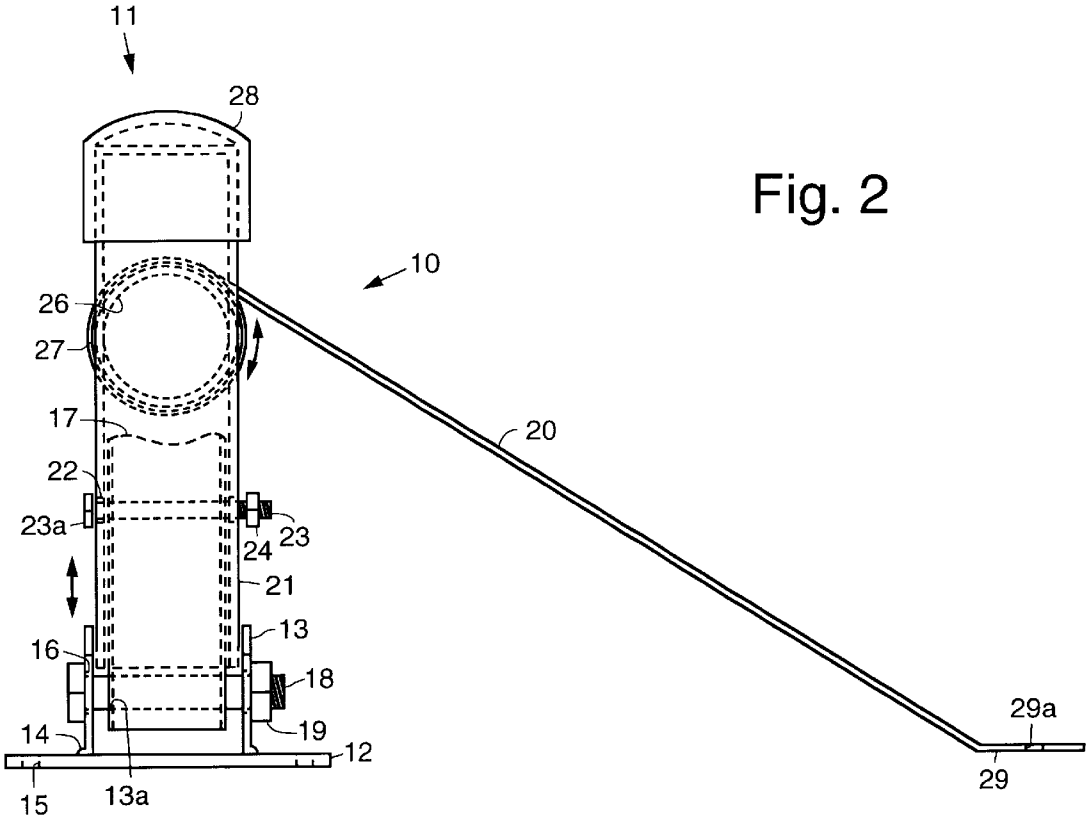
FIG. 2 illustrates a side view of a preferred embodiment of the adjustable support system.

Referring to the drawing figures, FIG. 1 illustrates various embodiments of exemplary adjustable support systems 10 in accordance with the principles of the present invention, while FIG. 2 illustrates a side view of a preferred embodiment of the adjustable support system 10. The adjustable support systems 10 shown in FIGS. 1 and 2 have a number of dashed lines shown therein that illustrate portions of components that are housed within other components or alternative configurations of the system 10. Double headed arrows shown in FIGS. 1 and 2 illustrate the slidable and rotatable nature of the components of the adjustable support systems 10.

A preferred embodiment of the exemplary adjustable support system 10 comprises first and second support members 11 that are offset from each other. The first and second support members 11 each comprise a base 12 that may be secured to a surface or object. The base 12 preferably has a plurality of holes 15 therethough that allow it to be secured to the surface or object. The base 12 comprises a U-shaped member 13 or other similarly functioning bracket 13 that projects away from a surface thereof. The U-shaped member 13 or bracket 13 may be part of the base 12 (formed by casting, for example) or may be secured to the base 12 by one or more welds 14, for example. The U-shaped member 13 or bracket 13 of a reduced to practice embodiment of the adjustable support system 10 comprises an L-shaped bracket and a vertical tab, which are welded to the base 12 and to each other (shown in FIG. 2).

A first or inner member 17, which is preferably tubular, is rotatably attached to the U-shaped member 13 or bracket 13 of each support member 11 at a joint. Different first or inner tubular member 17 may have different lengths, which allow each support member 11 to have selected overall lengths. Typical lengths of the first or inner member 17 of reduced to practice embodiments are from about 6 to 12 inches.

The first or inner tubular member 17 may be rotatably secured to the U-shaped member 13 using a locking mechanism 18,19 such as a bolt 18 that extends through holes 16 in the first or tubular member 17 and holes 13*a* in the U-shaped member 13 or bracket 13, and a nut 19 that is tightened onto the bolt 18. Alternatively, the joint may be formed as a lockable ball joint, for example that is attached to the end of the first or inner member 17.

A second or outer tubular member 21 is slidably attached to the first or inner tubular member 17 of each support member 11. A protective cap 28, or other resilient member 28, for example, may be disposed to cover the exposed end of the respective second or outer tubular members 11.

The inner and outer (first and second) tubular members 17, 21 are thus slidable with respect to each other and the outer (second) tubular member 21 may be positioned at different distances from the base 12. The inner and outer (first and second) tubular members 17, 21 may also be locked in a desired position such as by means of a locking mechanism 23, 24 such as a bolt 23, for example, that extends through holes 22 in the inner and outer (first and second) tubular members 17, 21 and a nut 24 that is tightened onto the bolt 23.

Multiple sets of holes 22 are disposed through the inner (first) tubular member 17 that permit locking of the support member 11 at different positions. The positions that the outer (second) tubular member 21 with respect to the inner (first) tubular member 15 are locked at may be different for the respective support members 11.

The inner and outer (first and second) tubular members 17, 21 need not necessarily be tubular, and may be flat members 17, 21 with one more holes therein that permit the inner and outer (first and second) tubular members 17, 21 to be secured together to provide a structure having different overall lengths. Furthermore, the inner and outer (first and second) tubular members 17, 21 may be threaded to allow relative positioning thereof.

Referring to FIG. 2*a*, it illustrates details of an alternative embodiment of the adjustable support system 10, and in particular support members 11 that employ threaded tubular members 17, 21. The threaded tubular members 17, 21 may be secured together by means of a rotatable locking mechanism 18*a* such as a threaded collar 18*a* that is rotated along the threaded inner (first) tubular member 17 until it is locked tightly against the outer (second) tubular member 21 to prevent movement thereof.

A first transverse member 26 is attached to the outer (second) tubular member 21 (or flat member 21) of the first support member 11. A second transverse member 27 is attached to the outer (second) tubular member 21 (or flat member 21) of the second support member 11. This interconnection is illustrated by the dashed (phantom) nut, bolt and hole locations 29 shown in FIG. 1. The first transverse member 26 is slidable with respect to the second transverse member 27. This allows for lateral or transverse positioning of the first and second support members 11 at different distances from each other.

If the first and second transverse members 26, 27 are tubular (circular), the first and second support members 11 may be rotated with respect to each other around axes of the if the first and second transverse tubular members 26, 27. This, in conjunction with the rotatable joint provided between the base 12 and the inner (first) tubular member 17, allows one of the support members 11 to be secured to a different surface than that of the other support member 11.

An optional rotatable member 20, or kicker 20, may be coupled at a first end to the outer transverse member 27. A second end 29 of the rotatable member 20 preferably has a hole 29*a* therein that allows it to be secured to a surface. Use of the rotatable member 20, or kicker 20, helps to stabilize the adjustable support system 10 when it is secured to one or more surfaces. If flat transverse members 26, 27 are employed, then the rotatable member 20 may be hinged and attached to one or both of the flat transverse members 26, 27.

The components of each support member 11 including the inner and outer (first and second) members 17, 21, the base 12 including the bracket 13, and the first and second transverse members 26, 27, and the optional rotatable member 20, or kicker 20, may be made from metal such as stainless steel, galvanized steel or aluminum, for example. Reduced to practice embodiments of the adjustable support system 10 were made from galvanized steel.

Figure 3:
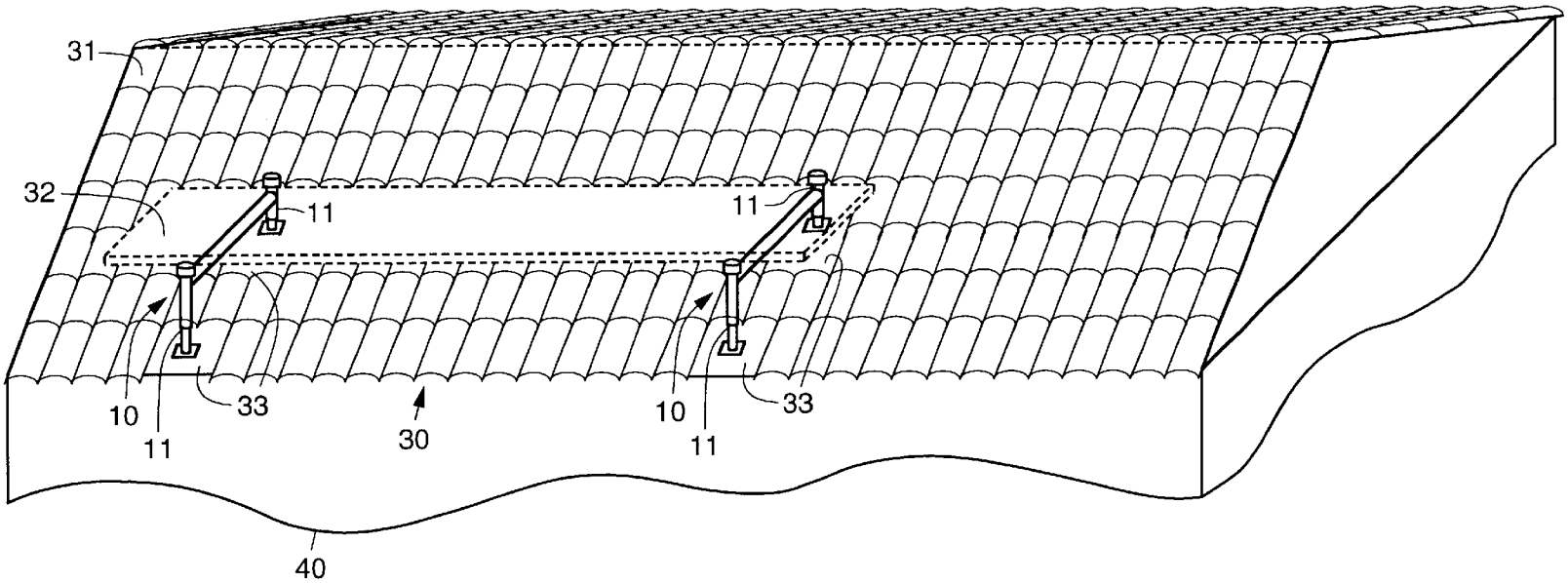
FIG. 3 illustrates use of the adjustable support system in a roofing application.

FIG. 3 illustrates use of the exemplary adjustable support system 10 in a typical roofing application. In such a typical roofing application, it is necessary for workers to walk onto a sloped roof 30 of a building 40, such as a house or apartment roof 30. The workers are normally required to walk or otherwise be supported by breakable tiles 31 on the roof 30. For example, this is typically required if the house 40 is fumigated, or if window washing, gutter installation, or antenna installation, is required.

In using the present invention, several tiles 31 are removed from the roof 30 or lifted and rotated or slid out of the way, to expose the underlying protective paper or wood, as is shown by the exposed areas of the roof 30 identified by reference numeral 33. The respective support members 11 of each adjustable support system 10 is secured to the exposed areas 33 of the roof 30, by means of wood screws, for example.

In this illustrative example, since the roof 30 is sloped, the lower support member 11 of each adjustable support system 10 is extended so that the transverse members 26, 27 are generally horizontal. Then a plank 32, for example, such as a two-by-eight, two-by-ten or two-by-twelve wood beam, for example, is laid on top of the respective transverse members 26, 27 to provide a walking surface for the workers. Thus, since the workers are supported by the plank 32 above the roof 30, the roof tiles 31 are not damaged by the workers while work is done of the house 40.

Although the adjustable support systems 10 are shown so that the plank 32 is oriented laterally across the roof 30, they may readily be secured in a direction that is transverse to, or angularly different from, the one shown in FIG. 33. Thus, two adjustable support systems 10 may be secured to top and bottom areas 33 of the roof 40 so that the plank 32 extends in a direction that is transverse to the one shown in FIG. 3. Also, since the adjustable support systems 10 may be adjusted by appropriately rotating the joints and sliding the components along their slidable axes or surfaces, the plank 32 may be supported in any arbitrary direction with respect to the roof 30.

Figure 4:
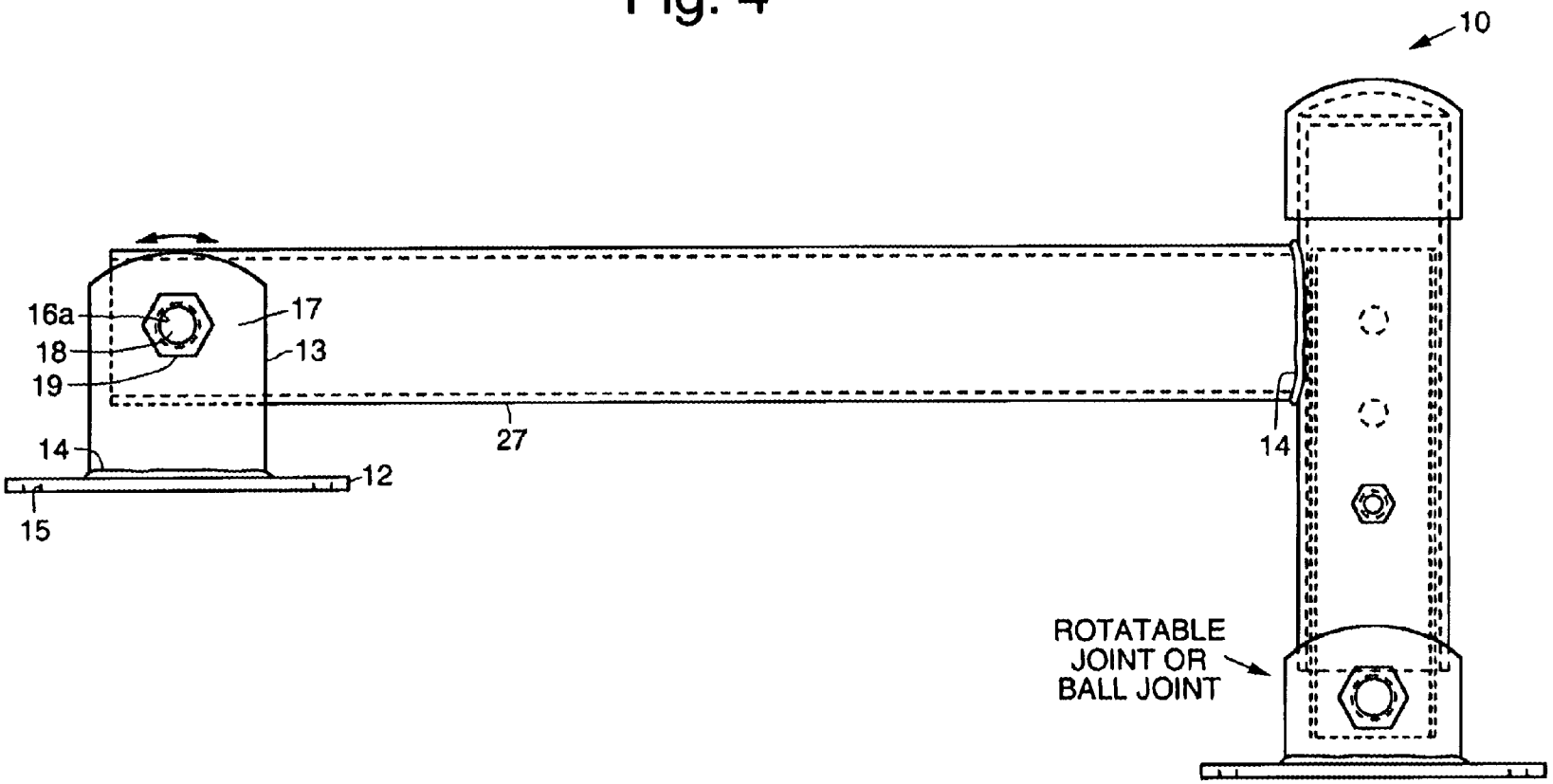
FIG. 4 illustrates an alternative embodiment of the adjustable support system.

FIG. 4 illustrates an alternative embodiment of the adjustable support system 10. In this embodiment of the support system 10, the transverse member 27 (or 26) of one of the support members 11 has one or more holes 16*a* therethrough (depending upon whether it is tubular or solid) that is distal from the outer (second) tubular member 21 (or flat member 21). The transverse member 27 is rotatably attached and secured directly to the base 12, such as to the U-shaped member 13 or bracket 13 thereof by means of a locking mechanism 18, 19 such as a bolt 18 and nut 19. Thus, in this embodiment, the base 12 is removed from one of the support members 11 and is attached to the transverse member 27, 26 of the other support member 11.

The use of the adjustable support system 10 is not limited to use in only roofing applications. The adjustable support system 10 may be attached to a vehicle, such as a truck, for example, to permit ladders or other materials to be supported by and locked thereto so that they may be transported. For example, a typical roof rack attached to a truck has fore and aft lateral tubes or bars that extend across the back of the truck at a predetermined height above the bed. An adjustable support system 10, in an inverted position, may be secured to the fore and aft lateral tube or bar by means of a U-bolt, for example. The length of the respective transverse members 26, 27 is chosen so that the support members 11 are separated by a desired distance. The separation of the support members 11 is chosen to allow ladders, wood or other object(s) to rest on and be supported by the transverse members 26, 27 of the fore and aft adjustable support systems 10.

Thus, an improved adjustable support system has been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An adjustable support system comprising:

first and second offset support members that each comprise:

a base;

a first member rotatably and lockably attached to the base;

a second member slidably and lockably attached to the first member; and a transverse member attached to the second member;

and wherein the transverse members of the first and second offset support members are coupled together and are laterally adjustable with respect to each other.

2. The system recited in claim 1 wherein the base has one or more holes therethough that allow it to be secured.

3. The system recited in claim 1 wherein the base comprises a U-shaped member.

4. The system recited in claim 1 wherein the first member is tubular.

5. The system recited in claim 1 wherein the base comprises a bracket and the first member is rotatably secured to the bracket by a locking mechanism.

6. The system recited in claim 1 wherein the first and second members are threaded tubular members and wherein the locking mechanism comprises a threaded collar.

7. The system recited in claim 1 further comprising a protective member disposed to cover an exposed end of the second member.

8. The system recited in claim 1 further comprising a rotatable member coupled at a first end to a selected transverse member and having a hole therein that allows it to be secured.

9. The system recited in claim 1 wherein the first member is rotatably and lockably attached to the base at a ball joint.

10. An adjustable support system comprising:

first and second offset support members that each comprise:

a base;

an inner tubular member rotatably and lockably attached to the base;

an outer tubular member slidably and lockably attached to the inner tubular member; and a transverse member attached to the outer tubular member;

and wherein the transverse members of the first and second offset support members are coupled together and are laterally adjustable with respect to each other.

11. The system recited in claim 10 wherein the base has one or more holes therethough that allow it to be secured.

12. The system recited in claim 10 wherein the base comprises a U-shaped member.

13. The system recited in claim 10 wherein the base comprises a bracket and the inner tubular member is rotatably secured to the bracket by a locking mechanism.

14. The system recited in claim 10 wherein the inner and outer tubular members are threaded and wherein the locking mechanism comprises a threaded collar.

15. The system recited in claim 10 further comprising a protective cap disposed to cover an exposed end of the outer tubular member.

16. The system recited in claim 10 further comprising a rotatable member coupled at a first end to a selected transverse member and having a hole therein that allows it to be secured.

17. The system recited in claim 10 wherein the first member is rotatably and lockably attached to the base at a ball joint.

18. An adjustable support system for use on an inclined surface, comprising:

a first support member that comprises a first base that is attachable to the inclined surface, a first member rotatably lockably attached to the first base, a second member slidably and lockably attached to the first member, and a transverse member attached to the second member; and a second support member that comprises a second base that is attachable to the inclined surface and that is rotatably attached to the transverse member of the first support member;

and wherein the first and second bases are attachable to the inclined surface and wherein the second member is slidable and lockable at a position relative to the first base so as to maintain the transverse member substantially horizontal.

19. The system recited in claim 18 wherein the first and second bases comprise U-shaped members.

20. The system recited in claim 18 wherein the first base comprises a bracket and the first member is rotatably secured to the bracket by a locking mechanism.

* * * * *